United States Patent [19]

Kaufmann et al.

[11] Patent Number: 4,525,057

[45] Date of Patent: Jun. 25, 1985

[54] GUIDE PATH FOR TRANSFER OF SHEETS TO A FIXING APPARATUS OF A COPYING MACHINE

[75] Inventors: Heinrich Kaufmann, Stuttgart; Friedhelm Brenner, Reichartshausen, both of Fed. Rep. of Germany

[73] Assignee: Develop Dr. Eisbein GmbH & Co., Fed. Rep. of Germany

[21] Appl. No.: 414,267

[22] Filed: Sep. 2, 1982

[30] Foreign Application Priority Data

Sep. 12, 1981 [DE] Fed. Rep. of Germany ..... 3136310

[51] Int. Cl.[3] ..... G03G 15/20; G03G 15/00; B65H 9/00; B65H 5/06

[52] U.S. Cl. ..... 355/3 FU; 355/3 SH; 355/3 TR; 271/226; 271/242

[58] Field of Search ..... 355/3 FU, 3 R, 3 BE, 355/3 DR, 3 SH, 3 CH, 3 TE, 3 TR, 14 R, 14 E, 14 D, 14 TR, 14 FU, 14 CH, 14 SH; 271/226, 188, 242, 198, 251, 311, 264, 209, 278, 314

[56] References Cited

U.S. PATENT DOCUMENTS

| | | | |
|---|---|---|---|
| 3,980,295 | 9/1976 | Kleid | 271/242 |
| 4,179,117 | 12/1979 | Rhodes, Jr. | 271/251 |
| 4,217,093 | 8/1980 | Steinlehner et al. | 355/3 FU X |
| 4,234,305 | 11/1980 | Miyake et al. | 355/3 FU X |
| 4,257,587 | 3/1981 | Smith | 271/242 X |
| 4,303,234 | 12/1981 | Plum | 271/226 X |
| 4,334,759 | 6/1982 | Clausing | 271/251 X |
| 4,355,225 | 10/1982 | Marsh | 355/3 FU X |
| 4,356,764 | 11/1982 | Haugen | 355/3 FU X |
| 4,362,502 | 12/1982 | Motomura et al. | 355/3 FU X |
| 4,365,795 | 12/1982 | Fukushima et al. | 271/242 X |
| 4,378,152 | 3/1983 | Edwards et al. | 355/3 FU |
| 4,419,003 | 12/1983 | Fujie et al. | 355/3 FU |
| 4,436,403 | 3/1984 | Rhodes, Jr. et al. | 271/226 X |

*Primary Examiner*—A. T. Grimley
*Assistant Examiner*—Terry Flower
*Attorney, Agent, or Firm*—Barnes & Thornburg

[57] ABSTRACT

Guide apparatus is provided for guiding paper from an image toner station to a pair of pressing rolls of a fixing station of a photocopying machine. The pressing rolls are arranged at a slight angle to the transport direction of the paper. In order to provide for simultaneous introduction of the paper across its width to the pressing rolls, the guide apparatus is so configured that the paper has different travel lengths across its width on its travel path between the toner station and the nip of the pressing rolls.

8 Claims, 3 Drawing Figures

GUIDE PATH FOR TRANSFER OF SHEETS TO A FIXING APPARATUS OF A COPYING MACHINE

The invention relates to apparatus for the transfer of sheets of paper from a toner imaging station to a fixing station of a photocopying machine. It is especially related to a copying machine with a fixing station having a pair of press rolls which are arranged at a slight angle to one another so that the pressing gap or opening between the press rolls is disposed at a slight angle to the transport direction of the sheets as supplied from the toner imaging station.

Relatively large pressing loads are experienced in the pressing rolls of photocopy machine fixing stations. These loads frequently lead to a bending of the pressing rolls. In order to have a linear formed pressing gap, and therefore a constant application of fixing pressure across the width of the sheets, in spite of the bending of the pressing rolls, the axles of the pressing rolls are arranged at a slight angle to one another. It is known to arrange the angular orientation of the pressing rolls, either with one pressing roll being at an angle to the normal paper transport direction or with a skewed positioning of both pressing rolls. When both of the pressing rolls are not of the same diameter and the same angular orientation, the pressing gap is shifted so that it extends at a slight angle to the normal paper transport direction. The angular orientation of the pressing gap must be chosen to be greater, the smaller the diameter of the pressing rolls, in order to compensate for the above noted bending problems.

Because of the arrangement of the pressing gap with respect to the paper transport direction being dependent upon the angular orientation of the pressing rolls, the danger results that the sheets are introduced at a relative angle into the pressing rolls so that under certain circumstances, folds or bends or the like are pressed into the sheets by these pressing rolls. If the sheet is located in the area of other handling stations, for example an exposure station or a development station, at the time it is introduced into and passes through the pressing rolls, it is especially important to avoid an angular and unequal introduction of the sheets. An angular introduction of the sheets into the press rolls can also lead to a disturbance of the exposure and/or the toner image. In large copying machines it is relatively simple to avoid these difficulties by providing for additional paper guidance apparatus with guide or transport rollers in front of the pressing rollers of the fixing station. Such an arrangement is not practical with small copying machines because of space and cost limitations.

The invention contemplates the provision of apparatus based upon the known art, which has the angular oriented pressing gap, but which includes an error free introduction of the forward edge of the sheets and therefore an error free path through the pressing rolls. The solution of the invention includes providing a guidance path for the sheets in front of the press rolls which exhibits different travel lengths across the width of the sheets.

Through the effective angular orientation of the transport apparatus it is assured that the sheets are guided especially with their forward edges into a certain predetermined position. The different lengths of the travel paths of the sheet portions across the width thereof across the normal transport direction assures the travel guidance of the forward edge of the sheets to the pressing gap of the pressing rolls so that they are precisely introduced into this pressing gap especially in a manner that the forward edges with their entire width are introduced at the same time into the pressing rolls.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figures 1, 2:
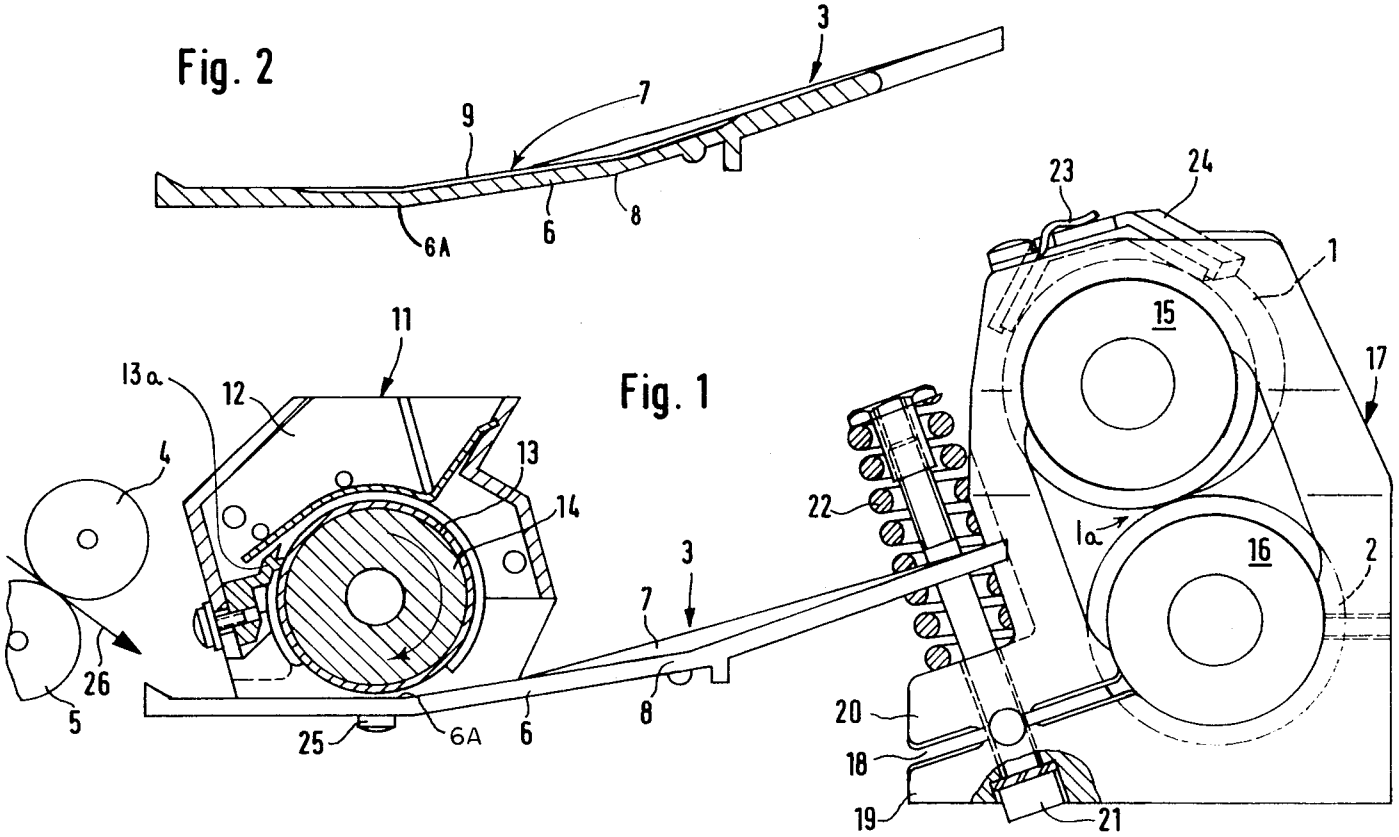
FIG. 1 is a schematic side view through a developing station and a fixing station of photocopying machine illustrating paper guide track apparatus in front of the fixing station constructed in accordance with a preferred embodiment of the invention.
FIG. 2 is a sectional view of the guide track of FIG. 1.

In the drawings and this description, only those features and structures are shown and described which are needed to disclose the invention to one skilled in the art of photocopying machines. Referring to FIG. 1, photocopying machine apparatus is schematically depicted for making copies on sheets of paper conveyed therethrough. The sheets travel through the machine from unillustrated sheet loading and exposing stations where a light image is formed on the photo sensitive surface of the paper. Thereafter, the sheets, as depicted by arrow 26, travel over a pair of transport rollers 4 and 5 to a toner station 11 where the exposed side of the paper is provided with a toner image corresponding to the light image received at the exposure station. The toner station 11 includes a toner storage chamber 12 for the toner, a magnetic roller 14 covered by a shell 13, and a "fur like" member 13*a* for transferring toner to the shell 13. The magnetic roller 14 is supported in the housing of the chamber 12 in a conventional manner not further illustrated or shown. Roller 14 is so driven that the toner "fur" on the cover 13 travels with high velocity in the opposite direction (as indicated by arrow in FIG. 1) of the transport direction of the paper sheets.

After the toner station 11, sheets which are provided with the toner image are led to a fixing station which includes pressing rolls 1 and 2. In this fixing station the toner image is pressed and fixed to the sheets. Both pressing rolls 1 and 2 are carried in press bearings 15 and 16 in the bearing block 17. The bearing block 17 includes two half cylindrical holders for the outer bearing rings 15 and 16. In the area of the bearing seats of the outer rings of these bearings for the bearing 16 which is under press roll 2, the bearing block or housing is provided with a slot 18. Portions 19 and 20 of the bearing block 17 form a slot 18 and are pressed together with high pressure by means of a tensioning screw 21 and a tensioning spring 22.

The bearing support 17 is provided at the top with clamping holders 23 for felt like strippers 24, which are arranged to be in contact with the toning image as it passes by the pressing roller 1. The axle of the lower pressing roll 2 extends at a right angle to the transport direction of the sheets, namely the longitutional direction of the copying apparatus. An unillustrated driving arrangement, preferably a chain drive, is provided for driving the lower pressing roll 2 as well as the magnetic roller 14. In order to provide a linear touching or pressing space between the pressing rolls 1 and 2, and therewith a pressing gap 1*a* with equal loading across the length thereof, the upper pressing roller 1 is disposed at an angle of approximately one degree with respect to the axle of the lower pressing roll 2. The thus provided contact line, the pressing gap 1*a*, is therefore angularly disposed with respect to the transport direction of the sheets, which means that the pressing line is at a slight incline to the transport direction of the sheets as they travel away from the toning station 11.

In order to provide that the incoming sheets have the full width thereof reaching the pressing gap simultaneously in spite of the slight angular orientation of the pressing gap between the rolls 1 and 2 with respect to the transport direction, a guide path 3 is provided which accommodates the orientation of the sheets or pages traveling thereover. The guide path 3 is constructed as a single pressure cast plate 6. The plate 6 is connected to the housing of the toner station 11 by means of screws 25 through slotted adjusting hole 25*a* in plate 6 (FIG. 3) in a predetermined position vis a vis the shell 13. The plate 6 is inclined with respect to the transport direction 26 of the upstream transport rollers 4 and 5 so that an entering sheet with its forward edge and also with the remaining region is guided in a predetermined manner on the guidepath 3.

Figure 3:
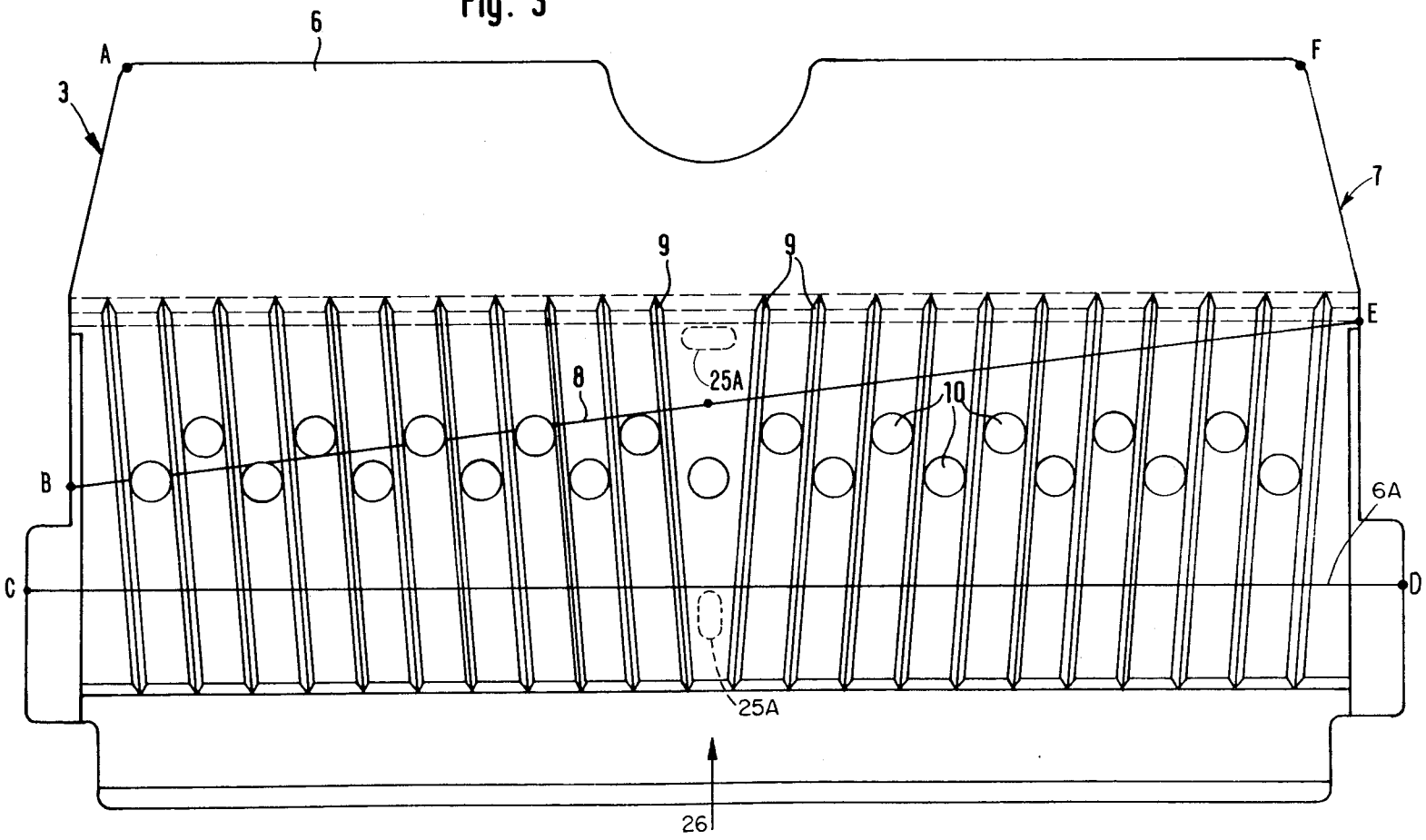
FIG. 3 is a view from above of the guide track of FIGS. 1 and 2.

Shortly after the paper contact point of the shell 13 and the magnet roller 14, a light break or bend line or angle 6A is provided in plate 6 so that the paper guide path extends further with a slight deflection in the direction of the fixing station. In this region between the toner station 11 and the fixing station, the plate 6 is so formed that in the paper travel direction, different traveling distances are provided across the width of the sheets, compensating for the inclined orientation of the pressing gap so that the forward edge of the incoming sheets simultaneously meets the pressing gap with its full width. To accomplish these differing travel distances across the width of the sheets, the plate 6 is provided with a cut-out or grooved portion or bend region defined between points A, B, C, D, E, and F in FIG. 3 which exhibits an angular formed cross section with flat walls extending from opposite sides of bottom or bend line 8. The groove 7 begins on the left side as shown in FIG. 3 and becomes progressively steeper in the direction to the other edge, at which it reaches its maximal depth. In this way the groove bottom line 8 extends in an inclined direction to the transport direction 26 with the beginning of the groove (the shallowest part) having the greatest distance to the fixing station pressing rolls 15, 16.

In the region of the toner station 11, the topside of the plate 6 is provided with ribs 9 which interconnect the incoming guiding surfaces and the following guiding surfaces. These ribs are inclined in respect to the transport direction 26, extending outwardly toward the outer edges of the plate 6 in the travel direction as illustrated in FIG. 3. The ribs 9 extend over the full length of the groove 7. In the region of these ribs 9 adjacent the toner station 11 are two rows of holes 10 arranged for accommodating the falling away of the toner material applied at station 11, which has been knocked away from the paper as it passes through the machine.

While we have shown and described a single embodiment in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as we are encompassed by the scope of the appended claims.

We claim:

1. In an apparatus for the transport of sheets of paper including in a photocopying machine, a first paper handling station and a fixing station having a pair of pressing rolls with respective pressing roll axes inclined to one another to form a pressing gap which is angularly inclined with respect to the paper transport direction of said sheets as they leave said first paper handling station, the improvement comprising:

paper guide path means disposed between said first paper handling station and said fixing station, said paper guide path means defining different paper travel lengths across the width of a sheet of paper traveling thereover so that all parts of the forward edge of that sheet simultaneously reach said pressing gap.

2. The apparatus according to claim 1, wherein said paper guide path means is a rigid plate member which exhibits a bend region of varying width with respect to said paper transport direction, extending across the width transversely to the travel of a sheet of paper coming from said first handling station, the surface of said bend region forming a travel path for a sheet of paper thereover.

3. The apparatus according to claim 2, wherein said bend region begins at one lateral edge of the plate member and extends to the opposite lateral edge of the plate member.

4. The apparatus according to claim 3, wherein said bend region includes upstream and downstream bend lines with respect to said paper transport direction to said pressing gap, said down stream bend line being at an angle with respect to said up stream bend line and extending across the width of said plate member, and flat walls extending upwardly from said down stream bend line.

5. The apparatus according to claim 4, wherein said down stream bend line extends diagonally with respect to said paper transport direction.

6. The apparatus according to claim 2, wherein upwardly protruding paper guide ribs are provided in said plate member at least in the area of said bend region.

7. The apparatus according to claim 6, wherein rows of holes for accommodating removal of toner material are provided in said plate member in the region of said guide ribs.

8. The apparatus according to claim 6, wherein said guide ribs extend generally in said paper transport direction and are respectively slightly angularly inclined toward the respective lateral edges of said plate member in said pipe transport direction.

* * * * *